United States Patent [19]

Patterson et al.

[11] Patent Number: 4,929,100

[45] Date of Patent: May 29, 1990

[54] TAUT BAND PIEZOELECTRIC ACTUATOR FOR WIRE MATRIX PRINTING ELEMENTS

[75] Inventors: William A. Patterson; Dien H. Tong; James R. Wooden, all of Charlotte, N.C.

[73] Assignee: International Business Machines Corp., Armonk, N.Y.

[21] Appl. No.: 347,373

[22] Filed: May 4, 1989

[51] Int. Cl.[5] ..... B41J 3/10

[52] U.S. Cl. ..... 400/124; 101/93.05

[58] Field of Search ..... 400/124; 366/127; 73/517 R; 101/93.05

[56] References Cited

U.S. PATENT DOCUMENTS

| | | | |
|---|---|---|---|
| 3,473,466 | 10/1969 | Thayer | 101/93 |
| 3,649,857 | 3/1972 | Knappe | 310/8.7 |
| 3,970,184 | 7/1976 | Helmrich et al. | 310/8.7 |
| 4,035,671 | 7/1977 | Schafft | 310/8.6 |
| 4,193,703 | 3/1980 | Sakmann | 400/124 |
| 4,547,086 | 10/1985 | Matsumoto et al. | 400/124 |
| 4,589,786 | 5/1986 | Fukui et al. | 400/124 |
| 4,783,610 | 11/1988 | Kaisha | 310/328 |

OTHER PUBLICATIONS

IBM Technical Disclosure Bulletin, vol. 20, No. 6, Nov. 1977, p. 2263.

IBM Technical Disclosure Bulletin, vol. 26, No. 8, Jan. 1984, p. 3984.

IBM Technical Disclosure Bulletin, vol. 26, No. 1, Jun. 1983, pp. 49, 50.

*Primary Examiner*—Edgar S. Burr

*Assistant Examiner*—Ren Yan

[57] ABSTRACT

This invention relates to printing elements for use in a serial wire matrix printer having a plurality of driven wire printing elements. Each printing element has actuating means associated therewith to drive the elements against a ribbon from a retracted position to an actuated position and returned. Each actuating means includes an elongated drive element anchored at opposite ends thereof to piezoelectric crystal stacks. The piezoelectric stacks have electrical supply means for causing expansion of the crystal stacks responsive to an electric signal. The drive element is normally maintained in a taut bowed position and is secured to the piezoelectric crystal stacks so as to be driven toward a straightened condition upon actuation to the piezoelectrical crystal stacks to thereby drive the printing element axially to the printing or actuated position from the retracted position upon actuation of the crystal assembly. Spring biasing means are provided which coact with the printing element to return the printing element to its retracted position when the electrical signal is removed or reversed in polarity.

10 Claims, 3 Drawing Sheets

10
12
12
13
13a
14
14
16
18

13
13a
13a
14
16
18
20
22
24
25

$|d_p|$
$L_f$
$\phi$
$L_i$
$|d_m|$

TAUT BAND PIEZOELECTRIC ACTUATOR FOR WIRE MATRIX PRINTING ELEMENTS

BACKGROUND OF THE INVENTION

1. Field of the Invention

This invention relates generally to wire matrix printing elements, and more particularly to serial wire matrix printing elements in which a piezoelectric crystal is used to actuate the printing wire or missile.

2. Prior Art

There have been many prior art proposals for actuation of serial wire matrix printhead devices. One conventional technique has been electromagnetic actuation wherein the printheads are actuated by electromagnetic phenomena to perform the printing function. This particular technique while having many advantages does have several serious limitations. One limitation is the inductance of the coil necessary to create the driving magnetic flux field which requires a reasonably long time for the current to build to its required value for actuation and thus limits the speed at which the device can operate. Further, due to the relative large amount of power consumed, thermal considerations typically play a very large part in the design of the device. Most printhead designs of this type require some means to sense the temperature of the printhead and to slow down, stop or partially disable the device if the heat rises above a preselected value, to prevent damage to the head. This also results either in a slowing down of the printing speed or a degradation in the quality of the printing output. Also, this arrangement, due to the large heat build up, prevents there being a large number of actuators tightly packed which also degrades the quality of the printed character. Also, because of packaging considerations, the total package is relatively large and bulky.

There has been suggested the use of printheads using piezoelectric actuators to overcome the problems enumerated above. The presently available types of designs of piezoelectric actuators include the multi-laminate benders (typically referred to as bimorph), and stacked multi-actuators.

The bimorph type configuration does provide the large displacement required for actuation of the print wire but has significant reliability problems as well as speed limitations and lacks the necessary precision in control of the required movement. U.S Pat. No. 4,035,671 as well as IBM Technical Disclosure Bulletin, Volume 26, No. 1, June 1983 at Pages 49 and 50 and IBM Technical Disclosure Bulletin, Volume 26, No. 8, January, 1984 at Page 3984 all disclose various aspects of bimorph type of piezoelectric actuation.

The stacked multi-layer actuated design provides quick response and low driving voltage and large generator forces. However, there is a very small displacement which requires some form of displacement amplification.

U.S. Pat. Nos. 3,473,466; 3,649,857; 4,783,610; 4,589,786; and U.S. Pat. No. 4,547,086 all disclose various forms of a mechanical amplification of movement of a piezoelectric crystal for amplification. U.S. Pat. No. 3,970,184 shows hydraulic amplification of piezoelectric movement and U.S. Pat. No. 4,193,703 and IBM Technical Disclosure Bulletin, Volume 26, November, 1977, Page 2263 shows a buckling beam type amplification of piezoelectric crystal actuation for printing elements. In this buckling beam type actuation, the piezoelectric crystals are energized which in turn actuates a beam which is in a flexed condition pushing it to a more flexed condition which operates against the printing wire. This configuration relies on the inherent strength and rigidity of the buckling beam to push the print wire. All of these devices have several limitations which limit their effective use.

SUMMARY OF THE PRESENT INVENTION

According to the present invention a serial wire matrix printer having a plurality of driven wire printing elements is provided wherein each printing element has actuator means associated therewith to drive the elements against a ribbon from a retracted position to an actuated position and returned. Each actuator means includes an elongated drive band anchored at opposite ends thereof. At least one end of the drive band has anchor means anchored to a piezoelectric crystal arrangement, which may be a single crystal but more preferably is a stack of crystals. The piezoelectric crystal arrangement has electrical supply means for causing expansion of the crystal arrangement responsive to an electrical signal. The drive band is normally maintained in a flexed position and secured to the piezoelectric crystal arrangement so as to be driven toward a straightened condition upon actuation of the piezoelectric crystal to thereby drive the printing element axially to the printing or actuated position from the retracted position upon actuation of the crystal assembly. The actuation means includes return means which preferably is a spring which will return the drive band to its retracted position upon deactuation or removal of the power or energy applied to the piezoelectric crystal assembly.

DESCRIPTION OF THE PREFERRED EMBODIMENT

Figure 1:
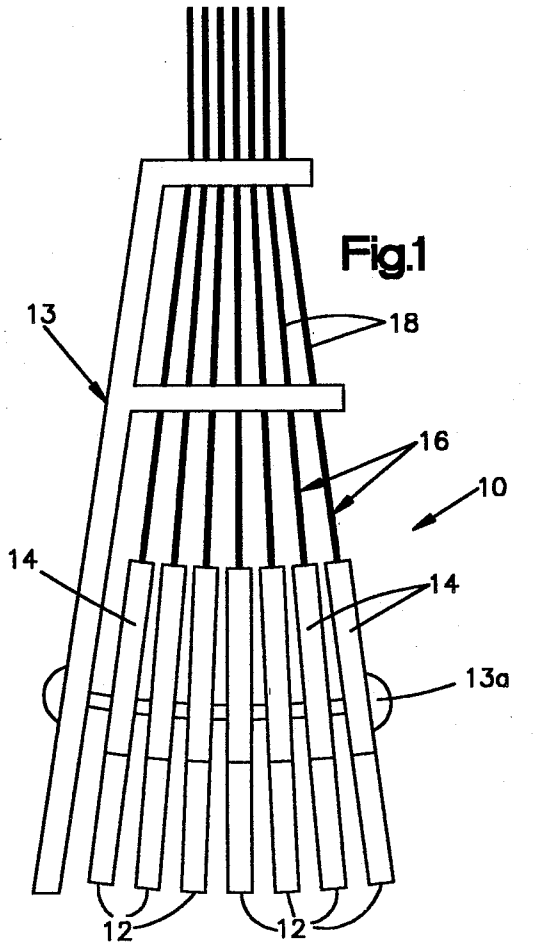
FIG. 1 is a side elevational view somewhat diagrammatic of an array of matrix wire driving devices in a printhead for a serial matrix printer.

Referring now to the drawing, and for the present to FIG. 1, a side elevational view somewhat diagrammatic shows one embodiment of a wire matrix printhead 10 having a plurality of superposed wire driving devices 12 arranged to print a desired array of dots on a substrate in a vertical line. The devices are secured to a support bracket 13 by means of fastening rivets or bolts 13*a*. (Although a vertical arrangement of printing devices is typical, other configurations are often used.) The wire driving devices 12 are constructed to operate between an actuated or printing position and retracted position, operating against a printing medium such as a printing ribbon (not shown) to transfer ink from the ribbon to a substrate in a dot pattern in a conventional manner. The arrangement of the ribbon and the substrate for printing is conventional and does not per se form any part of the present invention.

Figure 2:
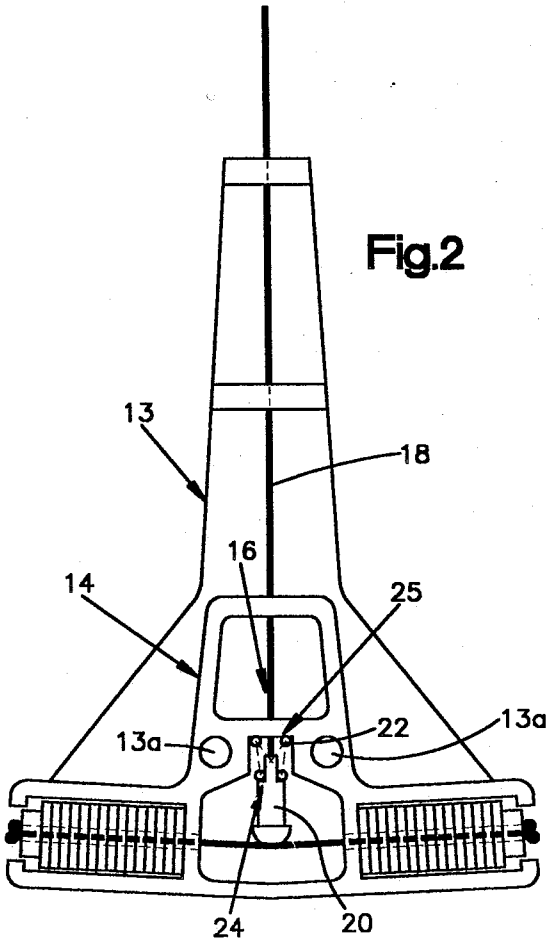
FIG. 2 is a plan view of the same array wire driving devices shown in FIG. 1.
Figure 3:
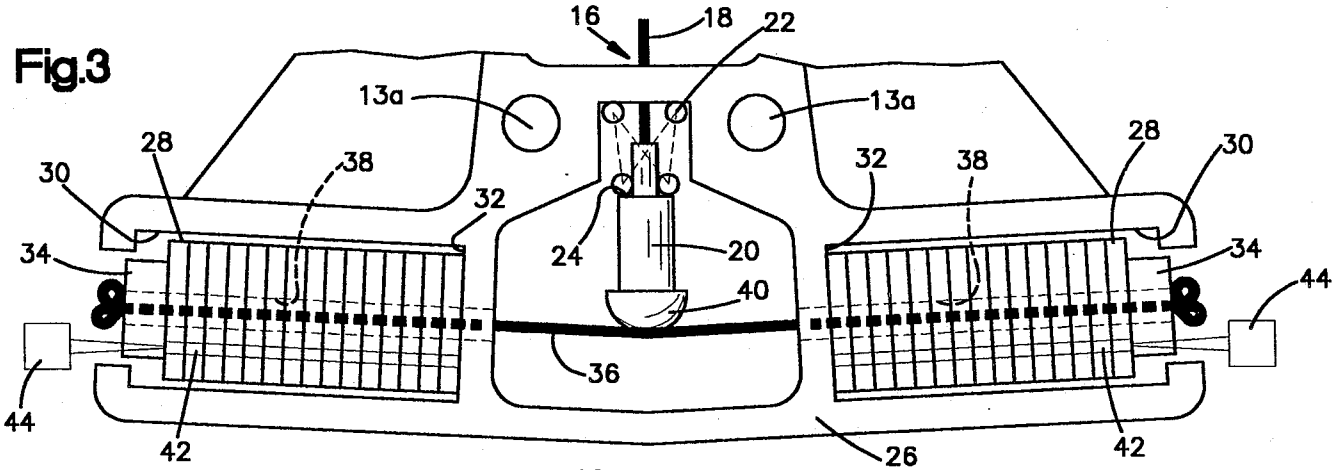
FIGS. 3 and 4 are enlarged views of a portion of the wire driving devices shown in FIG. 2 with the device being shown in its retracted position in FIG. 3 and its actuated position in FIG. 4.
Figure 4:
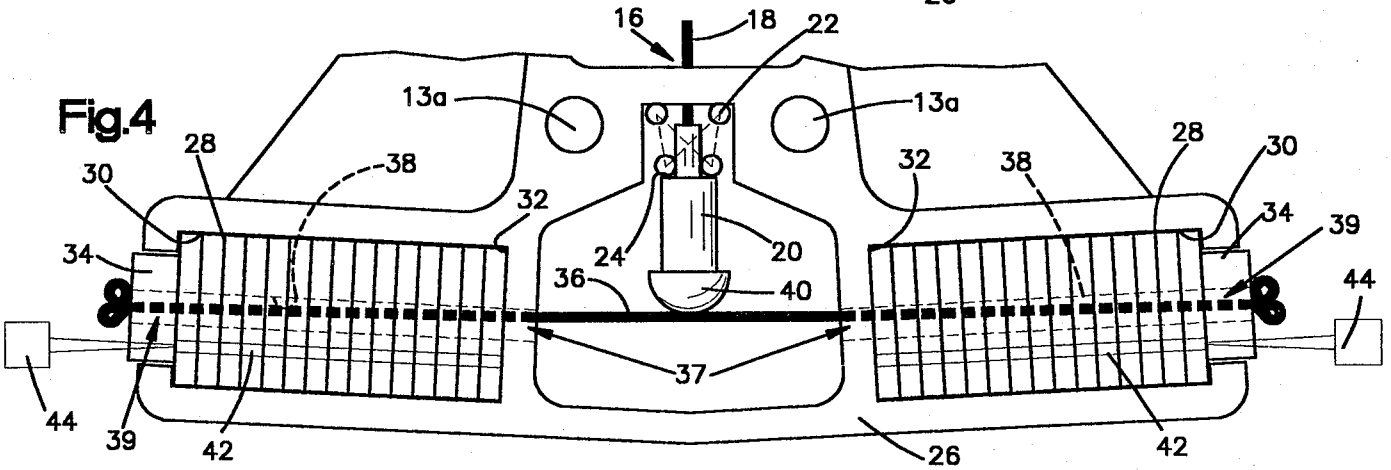

As can best be seen in FIGS. 2, 3 and 4 each wire driving device 12 includes a frame member 14, and a missiles 16 each of which missiles 16 has a wire end 18 and a head end 20. A coil spring 22 surrounds the missiles 16 and engages a shoulder 24 on the head 20 and a shoulder 25 on the frame member 14 thus normally biasing the missile downwardly to a retracted position as shown in FIG. 2.

The frame member 14 includes a T-Shaped mounting end 26 which is adapted to mount the actuating mechanism for the missile 16 and also engages the fastening rivets 13*a* to thereby secure the frame members 14 to the bracket 13. The actuating mechanism includes a pair of piezoelectric crystal stacks 28 each of which is disposed in a slot 30 formed in the mounting end 26 and disposed on opposite sides of the missile 16. The piezoelectric crystal stacks 28 are conventional types of crystal arrangements and can be purchased commercially from many different sources including NEC. One particular stack is Part No. AE0203DO8. This type of piezoelectric crystal stack arrangement is so configured that upon application of a voltage of one polarity it will expand, and upon an application of a voltage of the opposite polarity it will contract. This is a well-known phenomenon of piezoelectric crystals and the device of this invention relies on this phenomena for providing the actuation of the missile.

The piezoelectric crystal stacks 28 are disposed in the slots 30 with one end of each stack abutting against end wall 32 of its respective slot. The opposite ends of the piezoelectric crystal stacks 28 are provided with end caps 34. An elongated drive element in the form of a flexible drive band 36 is provided which extends through a continuous opening which is defined by a aperture 37 in the wall 32, an aperture 38 extending through the crystal stack 28, and an aperture 39 formed in the end cap 34. The flexible band 36 is secured at the opposite ends of the end caps 34 and is in engagement with the head end 20 of the missile 16. If desired, a groove 40 may be formed in the head end 20 to position the flexible drive band 36. Further, if desired, the head end 20 may be mechanically or metallurgically bonded to the flexible band 36. In the preferred embodiment, the band is flat, i.e. rectangular in cross section, but other cross sectional configurations can be used.

Each of the piezoelectrical crystal stacks 28 is provided with electric contacts 42 which contacts in turn are connected to a power source 44. In the absence of any power or alternatively when the power of a given polarity is applied, these electric stacks will be in the relaxed/retracted position maintaining the band taut with the spring 22 driving the missile 16 against the flexible drive band 36 to push it to a fully bowed or retracted position as shown in FIG. 3.

Upon application of a voltage through the contacts 42, to the crystal stack 28 of the polarity which will cause the crystal stacks 28 to expand the crystals will expand from the position shown in FIG. 3 to that shown in FIG. 4. The expansion in the direction laterally will cause the flexible drive band 36 to remain taut and move from the bowed condition shown in FIG. 3 to a less bowed actuated or printing position as shown in FIG. 4. This can be likened to the action of a bow string with the bow string driving an arrow which can be likened to the missile. This will drive the missile 16 from the retracted position shown in FIG. 3 to the actuated position shown in FIG. 4. The movement of the missile will drive the print wire 18 into contact with the ribbon which is pressed against the print medium to provide the dot in the required position upon actuation. When the voltage is removed or the voltage polarity is reversed by the contacts 42, the piezoelectric crystal stacks 28 will relax back to the position shown in FIG. 3 and the action of the spring 22 will drive the drive band 36 back to the position shown in FIG. 3.

Piezoelectric crystals have substantially greater strength in compression as opposed to their strength in tension. Hence the preferred arrangement of the drive band 36 with respect to the crystal stack 28 is such that the driving force results in a reaction force on the crystal stack 28 which puts it in compression.

Figure 6:
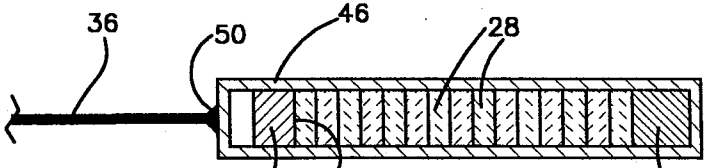
FIG. 6 is a sectional view taken substantially along the plane designated by the Line 6—6 of FIG. 5.
Figure 5:
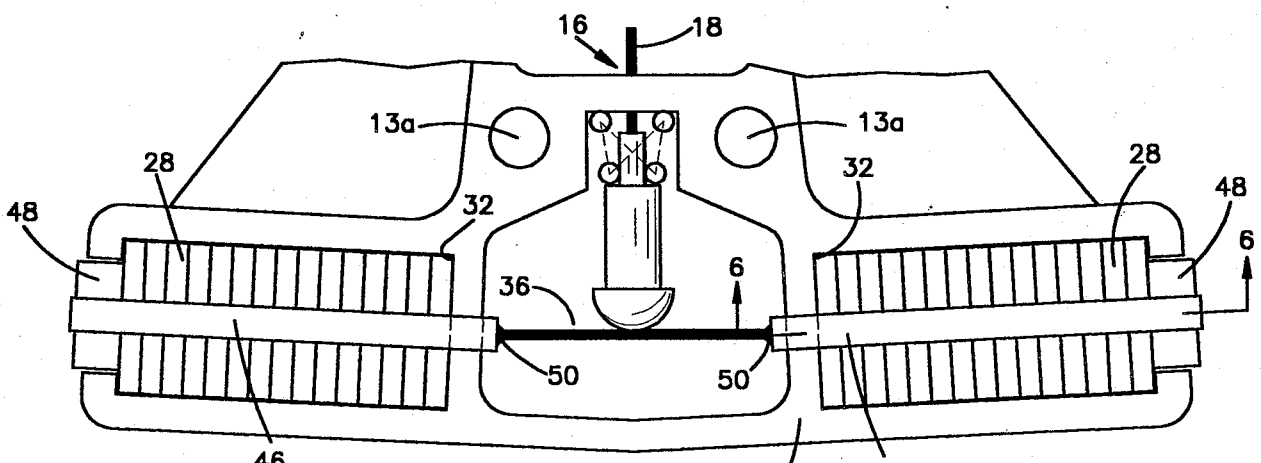
FIG. 5 is a view similar to FIG. 4 showing a somewhat different type of mounting of the band and piezoelectric crystals in the device.

FIGS. 5 and 6 show another arrangement for mounting the piezoelectric crystals stacks 28 and drive band 36 in the frame member 14, but which still results in a reaction force placing the crystal stacks 28 in compression. In this embodiment, a saddle 46 secures each crystal stack 28 with one end of the crystal abutting against the end wall 32 of the frame 14 in a manner similar to the previously described embodiment. An end cap 48 is disposed at one end of the saddle 46 abutting against the crystal stack 28. The drive band 36 is secured to the other end of the saddle as shown at 50. When power is supplied to the crystal stack 28, the expansion of the crystal stack 28 will move the saddle 46 to the right (as shown in FIG. 6) thus causing a tightening of the band 36, and the action of the band 36 will be just as described in the previous embodiment. In this case, of course, there is no need for an aperture through the crystal stacks 28.

Figure 7:
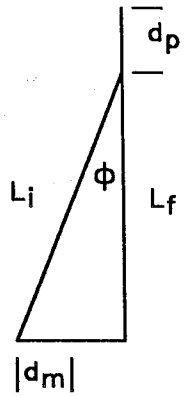
FIG. 7 is a diagram showing the relationship of various parameters of the driving device.

In determining the design characteristics or parameters of a device according to this invention including the amplification ratio, there are three dependent variables which have to be determined. These can be expressed in the following equations with the geometrical relationship being shown in FIG. 7.

Dp=displacement of piezoelectric crystal stack.

Dm=displacement of the "missile" or print wire.

Li=½ the active length of the drive band in the rest or retracted position.

Lf=½ the active length of the drive band in the "actuated" position.

Φ=the angle traversed by the drive band from its rest to fire position.

$$Li = \sqrt{Dm^2 + Lf^2} \quad \text{(Right Triangle)}$$

$$Dp = Li - Lf \quad \text{(By Geometry)}$$

$$Dp = (\sqrt{Dm^2 + Lf^2}) - Lf \quad \text{(Substitution)}$$

$$(Dp + Lf)^2 = Dm^2 + Lf^2 \quad \text{(Rearrange \& Sq.)}$$

$$Lf^2 + 2DpLf + Dp^2 = Dm^2 + Lf^2 \quad \text{(Expansion)}$$

$$Lf = (Dm^2 - Dp^2)/2\,Dp \quad \text{(Reduction)}$$

The three interdependent variables are Lf, Dm and Dp. In solving for any one variable, values have to be assumed for each of the other two. In formulating a machine design, the distance of travel required for the missile (Dm) is normally constrained by certain machine parameters, and the displacement of the crystal stack (Dp) is prescribed by what is commercially available. In such a case, these two values will dictate the active length of the band (2Lf).

For example, a value of Dm for certain typical applications is 0.012" ($305\times10^{-6}$ m) and one crystal stack sold under Part No. AE0203DO8 by NEC has a Dp value of about $8\times10^{-6}$ m.

Substituting these values in the above equations, the value of Lf would have to be 5.8 mm. (of course this represents only ½ of the drive band length, so this value has to be doubled to 11.6 mm to give the length of the drive band).

Since the amplification ration of the device is Dm/Dp, the value therein for this design is 38:1 (i.e. $305\times10^{-6}$ m/$8\times10^{-6}$ m). Other relationships can be calculated such as the angle Φ which represents the angle transversed by the drive band from its retracted position to its actuated position and, in this instance, has a value of 3°. Of course, selection of different values for the variables would give different results.

While several embodiments of this invention have been shown and described, various adaptations and modifications can be made without departing from the scope of the invention as defined in the appended claims.

What is claimed is:

1. In a wire matrix printer having a plurality of driven wire printing elements the improvement comprising;

each printing element having actuation means operably associated therewith to drive the element against a printing medium from a retracted position to an actuated position and return, said actuation means comprising an elongated flexible drive element anchored at opposite ends thereof, at least one end of said drive element having anchor means anchored to a piezoelectric crystal arrangement, said piezoelectric crystal arrangement having electrical supply means for causing change in the length of said crystal arrangement responsive to a change in the applied electrical potential, said drive element being normally maintained in a fully bowed retracted position and secured to said piezoelectric crystal arrangement so as to be driven toward an actuated less bowed condition by tightening said drive element upon a change in the electrical potential applied to the piezoelectric crystal arrangement to thereby drive said printing element axially to the actuated position from the retracted position.

2. The invention as defined in claim 1 wherein said anchor means anchoring the piezoelectric crystal assembly to the drive element includes means to maintain the piezoelectric crystal in compression during actuation.

3. The invention as defined in claim 2 wherein said electrical supply means cause expansion of said crystal arrangement for actuation thereof.

4. The invention as defined in claim 3 wherein said drive element is connected to the piezoelectric crystal arrangement at both ends thereof.

5. The invention as defined in claim 1 wherein the actuation means includes biasing means normally urging said printing element to the retracted position.

6. The invention as defined in claim 5 wherein said biasing means includes spring means operatively associated with said printing element.

7. The invention as defined in claim 1 wherein the drive element includes a flexible band extending through aperture means formed through said piezoelectric crystal means and said flexible band as secured at one end thereof to said piezoelectric crystal means.

8. An improved method of actuating printing elements in a wire matrix printer having a plurality of driven wire printing elements;

providing each printing element with actuation means to drive the element against a printing medium from a retracted position to an actuated position and return, said actuation means comprising an elongated flexible drive element anchored at opposite ends thereof, at least one end of said drive element having anchor means anchored to a piezoelectrical crystal arrangement, said piezoelectric crystal arrangement having electrical supply means for causing change in the length of said crystal arrangement between an actuated condition and relaxed condition responsive to a change in the applied electrical potential, normally maintaining said drive element in a retracted fully bowed position and secured to said piezoelectric crystal arrangement so as to be driven toward an actuated less bowed condition by tightening said drive element upon a change in the electrical potential applied to the piezoelectric crystal arrangement; and supply voltage to said piezoelectric crystal arrangement selectively to thereby drive said printing element axially to the actuated position from the retracted position; and thereafter removing or reversing said potential to allow said crystal arrangement to return to its relaxed position.

9. The invention as defined in claim 8 wherein said anchor means anchoring the piezoelectric crystal assembly to the drive element includes means to maintain the piezoelectric crystal in compression during actuation.

10. The invention as defined in claim 8 wherein spring biasing means are operatively associated with each said printing element to maintain each printing element in contact with said flexible drive element.

* * * * *